US009873181B2

(12) United States Patent
Talhami

(10) Patent No.: US 9,873,181 B2
(45) Date of Patent: Jan. 23, 2018

(54) TOOL, SYSTEM AND PROCESS FOR FINISHING A CYLINDRICAL MEMBER

(71) Applicant: Caterpillar Inc., Peoria, IL (US)

(72) Inventor: Humam S. Talhami, Minooka, IL (US)

(73) Assignee: Caterpillar Inc., Peoria, IL (US)

( * ) Notice: Subject to any disclaimer, the term of this patent is extended or adjusted under 35 U.S.C. 154(b) by 499 days.

(21) Appl. No.: 14/536,947

(22) Filed: Nov. 10, 2014

(65) Prior Publication Data

US 2015/0128392 A1 May 14, 2015

Related U.S. Application Data

(60) Provisional application No. 61/904,163, filed on Nov. 14, 2013.

(51) Int. Cl.
*B24B 39/04* (2006.01)

(52) U.S. Cl.
CPC ..... *B24B 39/04* (2013.01); *Y10T 29/476* (2015.01)

(58) Field of Classification Search
CPC ..... B24B 39/04; Y10T 29/476
See application file for complete search history.

(56) References Cited

U.S. PATENT DOCUMENTS

| | | | | |
|---|---|---|---|---|
| 704,428 | A * | 7/1902 | Allen | B24D 5/12 433/166 |
| 5,846,126 | A * | 12/1998 | Marvin | B24B 33/04 451/526 |
| 5,979,276 | A | 11/1999 | Blais et al. | |
| 7,507,147 | B2 | 3/2009 | Reim et al. | |
| 7,794,306 | B2 | 9/2010 | Kondo et al. | |
| 2009/0235503 | A1 | 9/2009 | Gruhler et al. | |
| 2012/0149288 | A1 | 6/2012 | Miyauchi et al. | |
| 2012/0204390 | A1 | 8/2012 | Prevey et al. | |

FOREIGN PATENT DOCUMENTS

| | | |
|---|---|---|
| GB | 694184 | 7/1953 |
| JP | 08066715 | 3/1996 |
| KR | 1088677 | 12/2011 |
| KR | 1132210 | 3/2012 |
| WO | 199505266 | 2/1995 |

* cited by examiner

*Primary Examiner* — Ryan J Walters
(74) *Attorney, Agent, or Firm* — M. Daniel Spillman

(57) ABSTRACT

A tool, system, and process for finishing a cylindrical member is provided. The finishing tool includes an opening. The opening is sized to receive a cylindrical member. The interior wall of the tool opening is configured to reduce a roughness of the cylindrical member. The opening has a second cross-sectional area that is less than the cross-sectional area of the member. A retainer can secure the member. In response to the opening interior wall slidably contacting a finishable area of the member as the finishing tool is moved relatively closer to the member at a relative force, the roughness of the finishable area of the member is reduced to a second roughness.

5 Claims, 4 Drawing Sheets

TOOL, SYSTEM AND PROCESS FOR FINISHING A CYLINDRICAL MEMBER

CROSS REFERENCE TO RELATED APPLICATIONS

This application claims the benefit and priority to U.S. Provisional Application No. 61/904,163, filed Nov. 14, 2013.

TECHNICAL FIELD

The present disclosure relates to tools, systems, and processes for finishing the exterior of cylindrical members, such as those used in hydraulic cylinders. valve spools, and piston pump pistons.

BACKGROUND

A hydraulic cylinder includes a hollow housing with a rod/piston assembly slidably disposed within the housing. The rod includes sealing elements circumferentially disposed therearound. Sealing elements can inhibit passage or leakage of oil within the housing to the outside environment and prevent contamination from entering into the housing. The effectiveness of the sealing elements can depend on the manufacturing tolerances of not only the sealing elements but also the cylinder rod. Another factor is the surface finish after the machining process and the resultant running surface bearing ratio. The type of running surface can affect the longevity of the sealing elements and the performance of the cylinder.

There have been attempts to improve the manufacturing of the cylinder rods. For example, a cylinder stock is machined by a turning process to bring the rod to near-final size and for roundness. A grinding process can clean up any marks that are left by the turning operation and surface defects. Abrasive processes can be used for finishing the surface such as a polishing process to remove grinding lines and surface defects and a buffing process to produce a bright smooth and substantially scratchless surface. Thereafter, a chrome layer is applied to the cylinder rod. Other examples include rollers compress centerless, diamond tool lathe, and outer diameter burnishing. In one example, U.S. Patent App. Publ. 2012/0204390 describes one burnishing process. Here, a burnishing operation is performed along at least a portion of a surface of a work piece using a burnishing tool. The burnishing tool has a tool head having a rolling element supported by a bearing formed from a low coefficient of friction polymer based material. The roller element is directed across the surface of the work piece to provide a surface treatment to the surface. However, with such burnishing process it is difficult to control the roundness of the work piece. Moreover, this process and other conventional finishing processes often result in a work piece with a highly variable surface finish at a microscopic level, resulting in a less than desirable bearing ratio in the case where a sealing element is applied to work piece. In addition, such a process could introduce bending into the rod.

SUMMARY OF THE DISCLOSURE

In one embodiment, a system to finish a cylindrical member is provided. A retainer of the system is fixedly secured to a cylindrical member. The retainer is configured to leave exposed a finishable area of the cylindrical member. The finishable area has a first cross-sectional area or diameter and a first roughness. A finishing tool of the system has a body having an interior wall defining an opening extending therethrough along a longitudinal axis. The opening has a second cross-sectional area or diameter less than the first diameter. At least the interior wall of the tool opening has a surface hardness greater than a surface hardness of the finishable area of the cylindrical member. In response to the opening of the finishing tool receiving the finishable area of the cylindrical member as the finishing tool is moved relatively closer to the cylindrical member at a relative force, the roughness of the finishable area of the cylindrical member is reduced to a second roughness.

In another embodiment, a process to finish a cylindrical member is provided. At least one step includes securing a cylindrical member to a retainer such that a finishable area of the cylindrical member is exposed. The finishable area has a first cross-sectional area or diameter and a first roughness. Another step includes slidably contacting an interior wall defining an opening formed in a finishing tool over the finishable area of the cylindrical member at a relative force. The opening of the tool has a second cross-sectional area or diameter less than the first cross-sectional area or diameter. At least the interior wall of the tool opening has a surface hardness greater than a surface hardness of the finishable area of the cylindrical member such that the roughness of the finishable area of the cylindrical member is reduced to a second roughness.

In yet another embodiment, a finishing tool to finish an outer surface of the cylindrical member is provided. An interior wall defining an opening of the tool extends along a longitudinal axis. The opening is sized to receive a cylindrical member. The interior wall of the tool opening is configured to reduce a roughness of the cylindrical member. The tool can include an attachment portion.

Other features and aspects of this disclosure will be apparent from the following description and the accompanying drawings.

DETAILED DESCRIPTION

Figure 1:
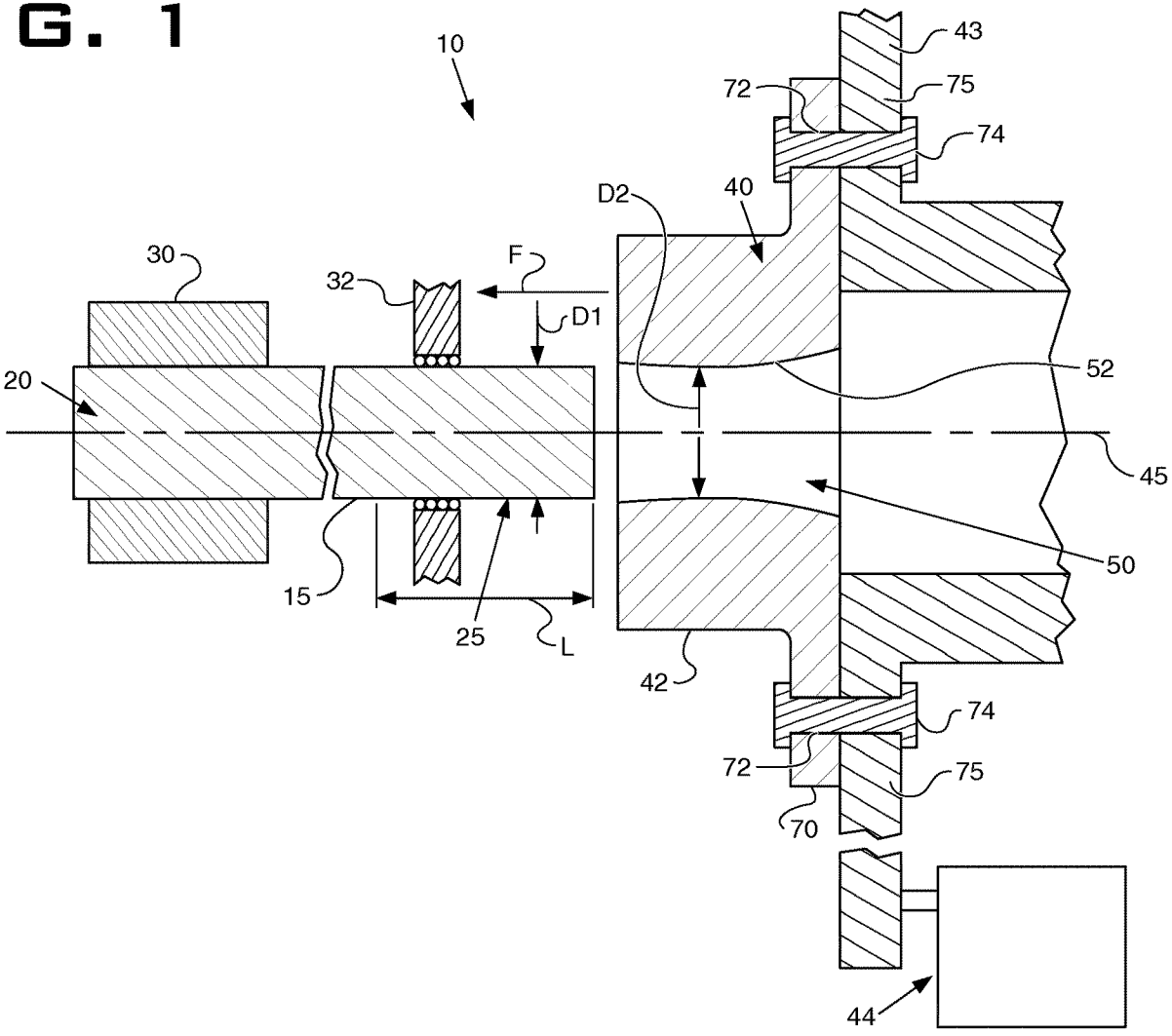
FIG. 1 depicts an exemplary system having a retainer coupled to a cylindrical member and a finishing tool coupled to a press.

FIG. 1 depicts an exemplary system 10 for finishing an outer surface 15 of a cylindrical member 20, such as a cylinder rod, a valve spool, a piston, or other similarly shaped members, to provide a desirable surface treatment to the outer surface 15. The system 10 includes a retainer 30 for securing the cylindrical member 20 in a fixed manner. The retainer 30 can include any known devices, such as a hydraulic actuated clamping device, a vice, a treaded mechanical clamping device. One or more intermediate support members 32, such as two-piece collar or roller bearing, may be provided along a section of the cylindrical member to prevent buckling of the cylindrical member during the process, such as can occur with longer rods. The retainer 30 is configured to provide sufficient clamping force to withstand longitudinal movement of the cylindrical member 20 during the process. The retainer 30 is configured to leave exposed a finishable area 25 of the cylindrical member 20. The finishable area 25 is sized to have an initial first cross-sectional area or first diameter D1. The retainer 30 may be a part of a hydraulic press 43.

The system 10 includes a finishing tool 40 for finishing the outer surface 15 of the cylindrical member 20. The cylindrical member 20 and the finishing tool 40 are configured to move relative one another at a relative force F. In one example, as shown in FIG. 1, the cylindrical member 20 is at a fixed position, while the finishing tool 40 is associated with a movable member 44 configured to provide at least one of linear and rotational movement. One of the benefits of linear sliding movement over rotational movement is that the linear movement does not leave a spiral path around the exterior of the cylindrical member, which can provide undesirably a leakage path to the oil under pressure. In another example, the finishing tool is at a fixed position, while the cylindrical member is associated with said movable member. In another example, both of the finishing tool and the retainer are associated with a corresponding movable members. The movable member shape and speed will be controlled to achieve the desired final product. The movable member 44 can be part of the hydraulic press 43. The movable member 44 can be configured to provide at least one of a pushing and pulling force to the corresponding cylindrical member and/or finishing tool. For example, for longer distances, it might be desirable to pull the cylindrical member through the finishing tool instead of using a pushing action. Linear movement may be achieved through a linear mechanism of the movable member 44, such as, e.g., a rail guide, a linear actuator, hydraulic cylinder (shown), guides, cables, chains, linkages, rollers or slides, preferably such that the movable member can also provide support.

Figure 2:
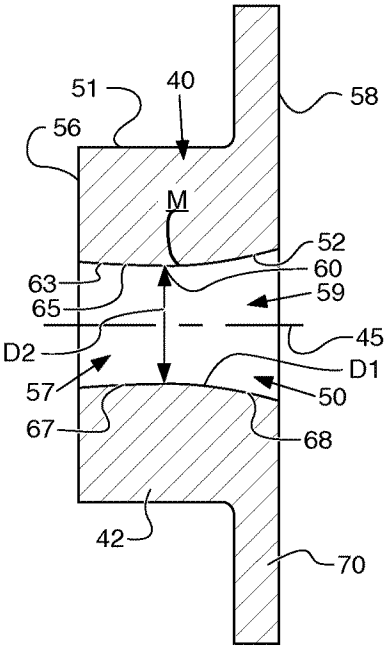
FIG. 2 is a cross-sectional view of an exemplary finishing tool.
Figure 7:
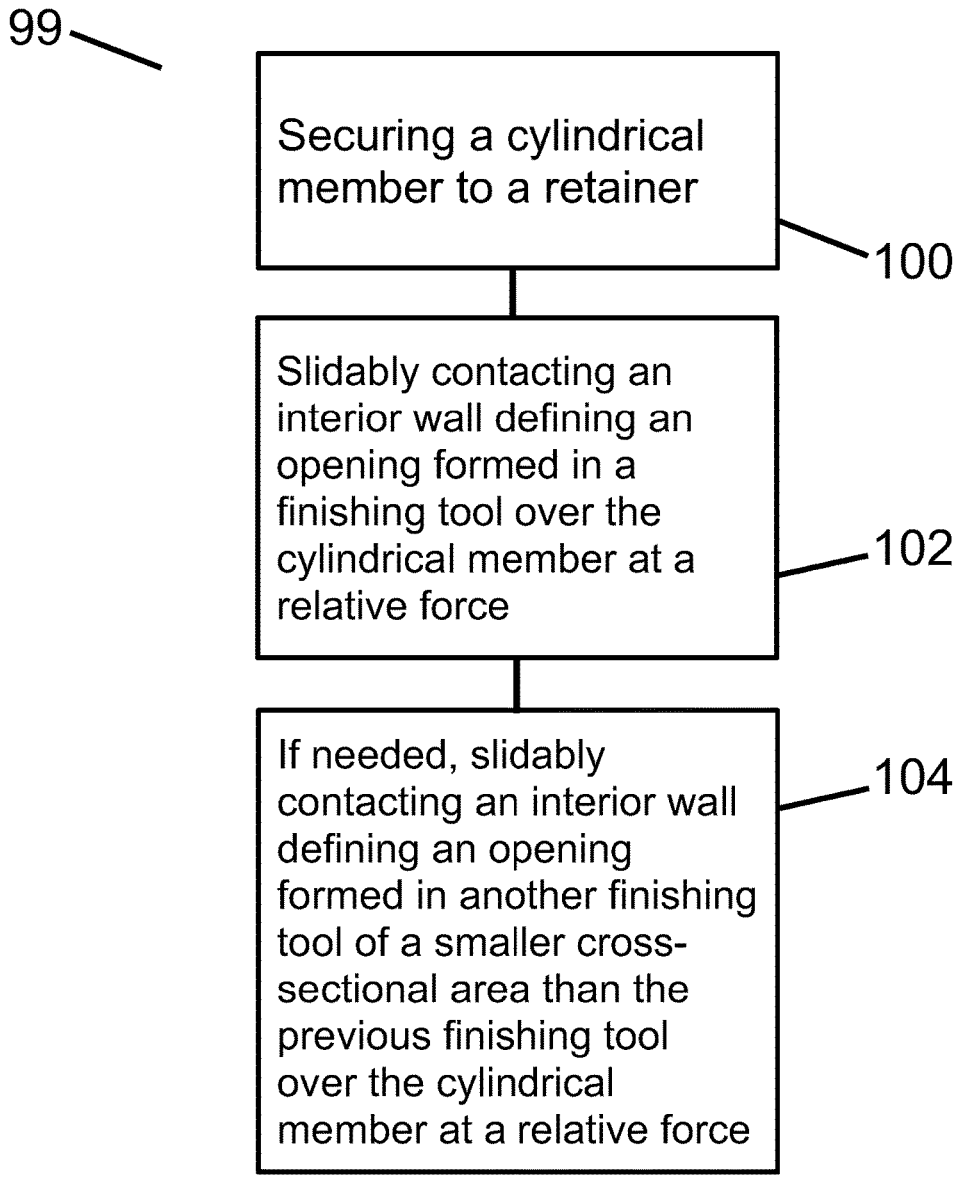
FIG. 7 depicts a block diagram of a process.

FIGS. 1-2 depict an exemplary finishing tool 40 used as part of the system. The finishing tool 40 includes an opening 50 formed in the tool body 42 of the tool 40 along a longitudinal axis 45. The tool body 42 can be tubular or ring shaped having an exterior surface 51 and an interior wall 52 to define the opening 50. The opening 50 can extend from a proximal surface 56 of the tool body 42 to a distal surface 58 of the tool body 42. The proximal and distal references are relative to the cylindrical member 20. A portion of the interior wall 52 forms an engaging surface 60 at the throat or narrowest portion of the opening 50 having a relative, second cross-sectional area or diameter D2 that is less than the cross-sectional area or diameter D1 of the outer surface 15 of the finishable area 25 of the cylindrical member 20. The engaging surface 60 is configured to perform the mechanical work required to modify the surface finish of the cylindrical member. In one example, the interior wall 52 defines a cylindrical opening. The interior wall 52 can be configured to increase the bearing ratio of the outer surface 15 of the finishable area 25 of the cylindrical member 20.

The opening 50 may have a wider mouth at a proximal end 57 and/or a distal end 59 of the opening 50 relative to the engaging surface 60 of the opening 50 in order to better receive the cylindrical member. For example, a proximal portion 63 of the interior wall 52 may define a larger diameter of the opening 50 than a more distal portion 65 of the interior wall 52 such that the engaging surface 60 is located between the proximal surface 56 and the middle M of the opening 50 defined between the proximal and distal surfaces 56, 58. In one example, the interior wall 52 can be tapered at least at the proximal end 57 of the opening 50 to form a proximal taper 67 having an increasingly larger cross-sectional area in the proximal direction along the axis 45. In addition to the proximal taper 67, or instead of, the interior wall 52 can be tapered at least at the distal end 59 of the opening 50 to form a distal taper 68 having an increasingly larger cross-sectional area in the distal direction along the axis 45. The distal taper 68 can reduce the friction and the force required to push or pull the rod through and allow the rod to slide freely without the possibility of galling or sticking. In addition, the distal taper 68 can facilitate quick expansion of the outer surface of the finishable area 25 when springing back to a size in between the original size and the engaging surface of the finishing tool.

In one example, when the finishing tool 40 has both tapers, the proximal taper 67 and the distal taper 68, the distal taper 68 can be larger than the proximal taper 67 to allow spring back fast and freely and to reduce required force to push or pull through. In one example, the location of engaging surface 60 can be closer to the proximal end 57 than the distal end 59 of the opening. In another example, the interior wall 52 can be formed with an arcuate or rounded surface along the axis 45 such that the engaging surface 60 is less than the diameter of the opening toward both the proximal and distal ends 57, 59 of the opening 50. This surface can be configured to perform the mechanical work required to modify the surface finish and impart the other benefits of roundness.

The finishing tool 40 may be provided with an attachment portion 70 to be used to fixedly secure the finishing tool 40 to the hydraulic press 43. The attachment portion 70 is shown as a flange radially extending from the tool body 42. In one example, the attachment portion 70 can include a plurality of attachment openings 72 such that attachment members 74, such as bolts, can be inserted therethrough to removably attach to a corresponding portion 75 of the hydraulic press 43.

The finishing tool 40, or at least the interior wall 52, can have a material hardness that is greater than the material hardness of the cylindrical member 20. The finishing tool 40, or at least the interior wall 52, can be composed of any sufficiently hard material that is sufficiently hardened and wear resistant, such as, e.g., D2 tool steel. The material of the finishing tool 40, or at least the interior wall 52, can be processed using a nitriting technique to lower the friction surface. and increase the hardness to improve help with material transfer. In one example, the cylindrical member 20 can be composed of any sufficiently hard material, such as, e.g., 1045 steel material having a Rockwell hardness of 57C.

Figure 8:
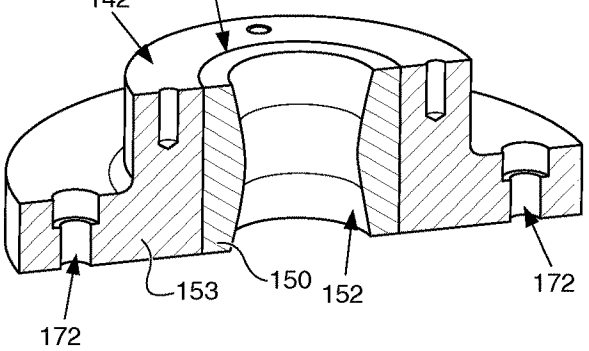
FIG. 8 is a sectional view of another embodiment of the finishing tool.

FIG. 8 depicts another embodiment of the finishing tool 40, referred to now as finishing tool 140, having one or more of the features described above with reference to the finishing tool 40. The body 142 of the finishing tool 140 includes an insert 150 that defines the interior wall, now referred to as interior wall 152. In this example, the body 142 includes an outer support structure 153 and the insert 150. The support opening 151 formed in the outer support structure 153 is sized to securely receive the insert 150. The insert 150 may be coupled to the outer support structure 153 or otherwise securely fixed to define the body 142 to be a unified body. For example, the outer surface of the insert 150 may be coupled or bonded or at least in engaging contact to the inner surface of the outer support structure 153. In this embodiment, the body and/or the interior wall 152 of the insert 150 can have a surface hardness greater than a surface hardness of the finishable area of the cylindrical member. Further, the body of the insert 150 may be formed of a material having a different hardness than the body of the outer support structure 153. The outer support structure 153 may include a flange extending radially outward away from the insert 150, where the attachment openings 172 are formed therein. In one example, the insert 150 may be removably attached, such as, e.g., described and shown more clearly with reference to FIG. 9, to the outer support structure 153 such that the insert 150 becomes a wear part that can be exchanged for one that has less wear.

Figure 9:
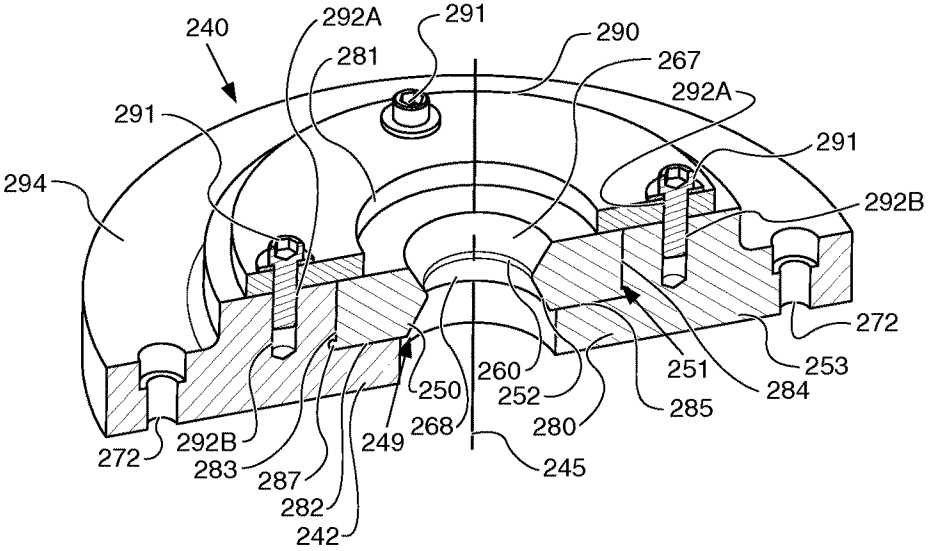
FIG. 9 is a sectional view of another embodiment of the finishing tool.

FIG. 9 depicts another embodiment of the finishing tool 40 or 140, referred to now as finishing tool 240, having one or more of the features described above with reference to the finishing tool 40 or 140. The body 242 of the finishing tool 240 includes the insert 250 that defines the interior wall, now referred to as interior wall 252. In this example, the body 242 includes the outer support structure 253 and the insert 250. The support opening 251 formed in the outer support structure 253 is sized to securely receive the insert 250. The insert 250 may be coupled to the outer support structure 253 or otherwise securely fixed to define the body 242 to be a unified body. For example, the insert outer surface 284 of the insert 250 may be coupled or bonded to the inner surface of the outer support structure 253. In this embodiment, the body and/or the interior wall 252 can have a surface hardness greater than a surface hardness of the finishable area of the cylindrical member. Further, the body of the insert 250 may be formed of a material having a different hardness than the body of the outer support structure 253.

The outer support structure 253 may include an inner flange 280 extending radially inward from main body of the outer support structure 253. Here, a proximal surface 282 of the inner flange 280 and the inner surface 283 of the outer support structure 253 defining confronting surfaces with the distally facing surface 285 and insert outer surface 284 of the insert 250, respectively. Where the proximal surface 282 of the inner flange 280 and the inner surface 283 of the outer support structure 253 intersect, a groove 287 or other geometric feature for stress-relief can be provided. The insert 250 can be placed securely within the outer support structure 253. The inner flange 280 can be sized accordingly so as to not interfere with the cylindrical member during the process. To further secure the insert 250 within the outer support structure 253, an attachment plate 290 can be positioned and placed over at least a portion of the proximal surface of the insert 250 to capture the insert 250 between the attachment plate 290 and the inner flange 280. As shown, the attachment plate 290 may be disk-shaped having a plate inner surface 281 defining an opening having a diameter or cross-sectional area less than the diameter or cross-sectional area formed by the inner surface 283 of the outer support structure 253, but large enough as to not interfere with the cylindrical member during the process. The attachment plate 290 may be removably attached to the outer support structure 253 through the use of removable attachment elements 291, such as bolts, extending through co-aligned attachment plate openings 292A, B formed in the attachment plate 290 and the proximal surface of the outer support structure 253, respectively. The outer support structure 253 may include an outer flange 294 extending radially outward away from main body of the outer support structure 253, where the attachment openings 272 are formed therein.

Similar to the opening 50 of the finishing tool 40, the opening 249 of the insert 250 of the finishing tool 240 may have a wider mouth at a proximal end and/or a distal end of the opening 249 relative to the engaging surface 260 of the opening 249 in order to better receive a cylindrical member. The interior wall 252 can be tapered at least at the proximal end of the opening 249 to form a proximal taper 267 having an increasingly larger cross-sectional area in the proximal direction along the axis 245. In addition to the proximal taper 267, or instead of, the interior wall 252 can be tapered at least at the distal end of the opening 249 to form a distal taper 268 having an increasingly larger cross-sectional area in the distal direction along the axis 245. As shown, the proximal taper 267 and the distal taper 268 may come together toward the middle of the opening 249 to form the engaging surface 260, leaving the longitudinal width of the engaging surface to a distance, for example, about up to about 0.125 inches, where at least a portion, and preferably all, of the surface peaks can be urged to lay down, rather than sheared.

INDUSTRIAL APPLICABILITY

The system and process described herein can be applied to cylinder rods, valve spools, and other cylindrical members. In one example, the desirable surface finish of the cylindrical member can be achieved by guiding the cylindrical member through the opening of the finishing tool that starts larger than the diameter of the rod but is smaller than the rod at the engaging surface of the finishing tool. The cylindrical member can be processed through multiple finishing tools of ever decreasing diameters of the engaging surface to achieve the desired roundness and surface finish type of the cylindrical member. In one example, the roundness may be true to about 1/10000 inch. Although cylindrical shapes are described, the process can be applied to rectangular or other geometric cross-sectional shapes with the notion that the cross-sectional shape of the opening formed in the finishing tool matches the cross-sectional shape of the member being processed.

Figure 5:
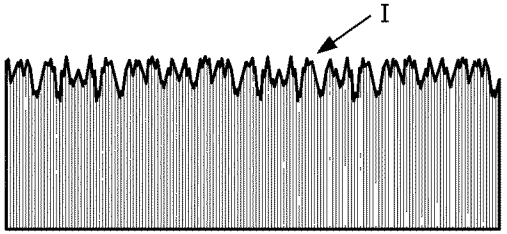
FIG. 5 is a magnified view of a surface finish of a cylindrical member prior to being processed by a process.

One of the advantages is that the system and process can provide a better surface finish type on the cylindrical member, i.e., a reduced roughness. Roughness can be expressed in a roughness parameter, such as roughness average (Ra), height of surface peak, and/or bearing ratio. To this end, a better surface finish may be expressed as a reduced roughness or a reduced Ra, a reduced surface peak height, or increased bearing ratio. For example, the surface finish can be improved to better than Ra of about 0.05 to about 0.4 microns from an initial roughness for the cylindrical member of about 32 micro-inch to about 48 micro-inch (0.8 to 1 micron). In one example, it can be improved to Ra of about 0.1 to about 0.3 microns. In another example, it can be improved to Ra of about 0.15 microns. In another example, the bearing ratio is increased when microscopically the height of at least partially some if not all of surface peaks is reduced or further laid down to a smaller height. Furthermore, whereas conventional process that involve spinning and cutting adversely impacted the surface finish where said surface type is not conducive to good wear and sealing performance of the sealing system, the system and process herein can provide improvements in these areas. In addition, the roundness of the member can more true, or can be trued to the same exactness as the tool opening itself 60. Further, the cylinder member can have better corrosiveness Referring now to FIGS. 3-7, an exemplary process 99 for finishing the outer surface 15 of the finishable area 25 of the cylindrical member 20. The initial surface finish I of the finishable area is shown in FIG. 5. At step 100, the cylindrical member 20 is secured to the retainer 30. In one example, the securement is such that the finishable area 25 of the cylindrical member 20 is exposed in order to receive the finishing tool 40, although the finishing tool could be any of the features of finishing tools 140 or 240, for sake of brevity the description will focus on the finishing tool 40.

At step 102, the interior wall 52 of the opening 50 of the finishing tool 40 is slidably contacted against the outer surface 15 of the finishable area 25 of the cylindrical member 20 at a relative force F. The finishing tool 40 is selected with the desired opening size. The opening 50 of the finishing tool 40 has the second diameter D2 that is less than the first diameter D1 of the finishable area 25 of the cylindrical member 20. For example, the first diameter D1 can be any diameter size. The second diameter D2 can be less than the first diameter D1 by an amount that is dependent on the type of material, the microstructure, and hardness, such as, e.g., up to about 0.003 inch less than the first diameter D1. In one example, the second diameter D2 can be less than the first diameter D1 by a larger amount and less than the diameter of cylindrical member 20 by up to 0.011 inch depending on the variables mentioned above. The selected finishing tool 40 can be attached to the press 43 via the attachment members 74 as shown in FIG. 1. The attachment members 74 permit quick removal and installation of different finishing tools with differently sized openings to be used.

Figure 3:
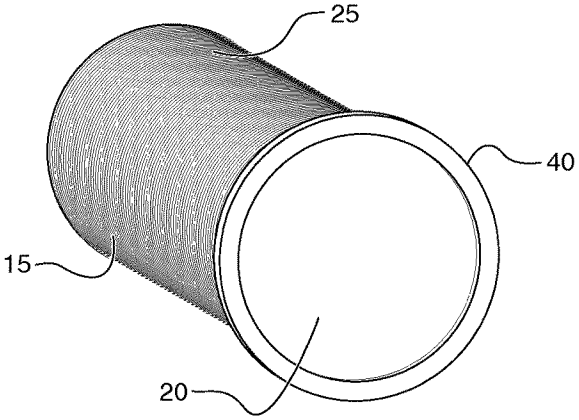
FIG. 3 is a perspective view of a finishing tool engaging a cylindrical member during a process.
Figure 4:
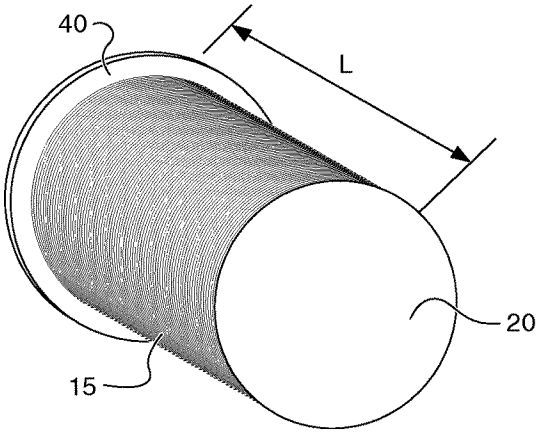
FIG. 4 is a perspective view of a finishing tool engaging a cylindrical member during a process at a subsequent step that shown in FIG. 3.

The interior wall 52 of the opening 50 is slidably contacted against the outer surface 15 of finishable area 25 of the cylindrical member 20 and is moved along the surface with sufficient force and exacting speed to produce the desired surface treatment of the surface. FIGS. 3-4 depict the sliding movement of the finishing tool 40 against the outer surface 15 of the finishable area 25 of the cylindrical member 20 for a longitudinal distance L. For example, the finishing tool 40 and the cylindrical member 20 are moved with a relative force F relative to one another, such that the end of the cylindrical member 20 is received by the opening 50 of the finishing tool 40. In one example, the finishing tool 40 can be moved at a first speed, e.g., about 20 mm/second toward the cylindrical member 20 at a first force, e.g., about 2000 pounds (force). The finishing tool can travel over the finishable area 25, typically traveling over the longitudinal distance L. The distance L can be any distance, such as, e.g., about 300 mm to about 2800 mm, including the entire length of the cylindrical member. The relative motion can be continuous and smooth to prevent the material of the cylindrical member from leaving ridges. The relative speed can be a constant speed at a range between about 20 mm/sec to about 204 mm/sec. The relative speed can be increased or reduced during the contacting step. For subsequent finishing tools process steps, the speed can be the same, faster or slower than the previous steps.

Figure 6:
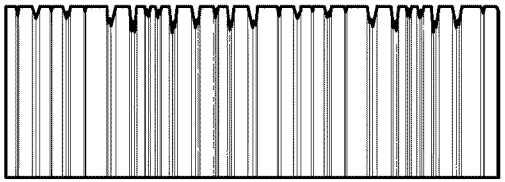
FIG. 6 is a magnified view of a surface finish of a cylindrical member subsequent being processed by a process.

After the initial pass, the outer diameter of the cylindrical member may be initially reduced up to in a range of about 0.003 to about 0.011 inch. However, material of the cylindrical member may spring back to a diameter larger than what was just reduced after the process. This may be sufficient for the intended purpose. For example, the final surface finish F of the finishable area is shown in FIG. 6. As shown, the finishing tool 40 can lay down the peaks of the initial surface area, thereby increasing the bearing ratio to a higher bearing ratio, which can leave a surface with less peaks that tend to increase wear and induce corrosion.

Alternatively, subsequent passes of a finishing tool can be applied to the cylindrical member. In some instances, if needed, another finishing tool having a third diameter less than the new diameter of the cylindrical member after the first pass, as step 104. The new diameter may be about the second diameter D2, which may require the third diameter to be up to about 0.009 inch less than the first diameter D1. There can be multiple passes of different finishing tools over the cylindrical member in order to achieve the desired surface finish. Each pass may be an incremental reduction in diameter of the opening of the finishing tool. In one example, the incremental reduced diameters can lead up to a reduced diameter of about 0.011 inch less than the first diameter D1. In another example, the diameter of the first finishing tool is 0.003 inch less than the first diameter D1, the diameter of the second finishing tool is 0.006 inch less than the first diameter, the diameter of the third finishing tool is 0.009 inch less than the first diameter, and the diameter of the fourth finishing tool is 0.011 inch less than the first diameter. Although four passes are described, more or less passes may be used to achieve the desired final diameter of the cylindrical member.

Furthermore, the relative force applied can stay the same during subsequent passes. In one example, the force can be increased to a greater force, such as, up to in a range of about 7000 to about 30,000 pounds (force). The force may be increased incrementally after each pass. A lubricant can be applied to the cylindrical member and/or the interior wall of the opening of the finishing tool. The lubricant can include a soap-based, oil-based, or other types of lubricants known in the art. The lubricant can reduce the amount of relative force F during the process.

In one example, the process 99 includes securing the cylindrical member 20 to the retainer 30 such that the finishable area 25 of the cylindrical member 20 is exposed. The finishable area 25 of the cylindrical member 20 has the first diameter D1 and a first roughness. The interior wall 52 defining the opening 50 formed in the finishing tool 40 is slidably contacted over the finishable area 25 of the cylindrical member 20 at a relative force, e.g., of about 30,000 pounds (force). The second diameter D2 of the opening 50 is less than the first diameter D1 of the cylindrical member, e.g., by about 0.011 inch. At least the interior wall 52 has a surface hardness greater than a surface hardness of the finishable area 25 of the cylindrical member 20 such that the roughness of the finishable area 25 of the cylindrical member 20 is reduced to a second roughness. In another example, the process 99 can be applied to a cylindrical member before the cylindrical member material is hardened through a hardening process.

Furthermore, the relative hardness of the interior wall of the finishing tool can stay the same during subsequent passes. However, the hardness can be increased to a greater hardness. The hardness may be increased incrementally after each pass. It can be appreciated by one of ordinary skill in the art, that diameter size, force, relative speed, and hardness, or any combination thereof, may be adjusted accordingly to achieve the desired surface treatment.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system to finish a cylindrical member, comprising:

a retainer to fixedly secure a cylindrical member, and configured to leave exposed a finishable area of the cylindrical member, the finishable area having a first cross-sectional area and a first roughness;

a finishing tool having a body having an interior wall defining an opening extending therethrough along a longitudinal axis and extending from a proximal surface of the body to a distal surface of the body, at least the interior wall having a surface hardness greater than a surface hardness of the finishable area of the cylindrical member;

wherein the interior wall is tapered at a proximal end of the opening to form a proximal taper of the interior wall, the proximal taper of the interior wall having an increasingly larger cross-sectional area in a proximal direction along the longitudinal axis;

wherein the interior wall is tapered at a distal end of the opening to form a distal taper of the interior wall, the distal taper of the interior wall having an increasingly larger cross-sectional area in a distal direction along the longitudinal axis;

wherein the interior wall includes at least one surface, the at least one surface of the interior wall including an engaging surface, the engaging surface formed as a portion of the interior wall which is at and forms a narrowest portion of the opening, wherein the engaging surface is located between a proximal portion of the interior wall and a middle of the opening between the proximal surface of the body and the distal surface of the body such that the engaging surface is located closer to the proximal end of the opening than the distal end of the opening;

wherein the interior wall is processed with a technique configured to lower friction of the at least one surface of the interior wall such that the interior wall which defines the opening is configured to slidably contact an outer surface of the finishable area of the cylindrical member; and wherein the distal taper is larger than the proximal taper such that the distal taper is configured to reduce friction and force required move the cylindrical member through the finishing tool.

2. The system of claim 1, wherein the interior wall is arcuate.

3. The system of claim 1, wherein the proximal portion of the interior wall defines a larger cross-sectional area of the opening than a more distal portion of the interior wall between the proximal surface and the middle of the opening.

4. The system of claim 1, wherein the finishing tool comprises an outer support structure having a support opening formed therein and an insert to be received in the support opening, the insert coupled to the outer support structure, wherein the insert defines the interior wall of the finishing tool.

5. The system of claim 4, wherein the outer support structure of the finishing tool includes an inner flange, wherein the finishing tool includes a removable attachment plate positioned to capture the insert between the attachment plate and the inner flange.

* * * * *